US009637894B2

(12) United States Patent
Jensen et al.

(10) Patent No.: US 9,637,894 B2
(45) Date of Patent: May 2, 2017

(54) CONNECTION ARRANGEMENT BETWEEN A FITTING UNIT AND A MEDIUM PIPE

(75) Inventors: Ruben John Jensen, Assens (DK); Jesper Bak Nielsen, Assens (DK); Torsten Heldbjerg Kjeldsen, Aarslev (DK)

(73) Assignee: BROEN-LAB A/S, Assens (DK)

( * ) Notice: Subject to any disclaimer, the term of this patent is extended or adjusted under 35 U.S.C. 154(b) by 1045 days.

(21) Appl. No.: 12/160,010

(22) PCT Filed: Dec. 13, 2006

(86) PCT No.: PCT/DK2006/000711

§ 371 (c)(1),
(2), (4) Date: Jul. 3, 2008

(87) PCT Pub. No.: WO2007/076861

PCT Pub. Date: Jul. 12, 2007

(65) Prior Publication Data

US 2009/0001711 A1 Jan. 1, 2009

(30) Foreign Application Priority Data

Jan. 3, 2006 (DK) ..... 2006 00011

(51) Int. Cl.
*E03C 1/00* (2006.01)
*E03C 1/04* (2006.01)

(52) U.S. Cl.
CPC .... *E03C 1/0403* (2013.01); *E03C 2001/0416* (2013.01)

(58) Field of Classification Search
CPC ..... F16L 29/002; E03C 1/0403; F16K 5/00
USPC ..... 285/148.1, 245–246, 249, 334.2, 285/353–354, 384–386, 389, 122.1, 285/124.5, 126.1, 129.1, 131.1–132.1, 285/289.1, 291.1; 251/318, 266–272
See application file for complete search history.

(56) References Cited

U.S. PATENT DOCUMENTS 275,269 A * 4/1883 Reid ..... 285/347
487,829 A * 12/1892 England ..... 285/39
538,634 A * 4/1895 Witham ..... 285/332.3
(Continued)

FOREIGN PATENT DOCUMENTS

DE 26 11 058 A1 11/1976
EP 0 937 828 A2 8/1999
(Continued)

OTHER PUBLICATIONS

International Search Report for International Application No. PCT/DK2006/000711.

*Primary Examiner* — David E Bochna
*Assistant Examiner* — James Linford
(74) *Attorney, Agent, or Firm* — David S. Safran

(57) ABSTRACT

A connecting arrangement for a fitting unit with a fitting housing (13). In the housing there is at least one bore (17, 18) for mounting a medium pipe (24, 36) by means of a threaded fitting 31, 34). The fitting may optionally be chosen as a nut (31) for squeezing a cutting sleeve 30) or as a soldering bushing (34) for mounting the medium pipe by soldering. Irrespectively whether there is a bore (17, 18) in the fitting housing or a bore in the soldering bushing 34), several parts with varying diameters would be provided so that medium pipes with different diameters can be fastened.

5 Claims, 7 Drawing Sheets

(56) References Cited

U.S. PATENT DOCUMENTS

| | | | | | |
|---|---|---|---|---|---|
| 743,022 | A | * | 11/1903 | Nightingale | F16K 11/0743 137/625.21 |
| 1,292,517 | A | * | 1/1919 | Robertshaw | 277/622 |
| 1,317,789 | A | * | 10/1919 | Hoar | E03C 1/042 137/360 |
| 1,791,121 | A | * | 2/1931 | Cowles | 285/341 |
| 2,476,908 | A | * | 7/1949 | Radcliffe | 138/39 |
| 2,584,845 | A | * | 2/1952 | Crawley | 285/122.1 |
| 2,676,037 | A | * | 4/1954 | Mueller | F16L 19/0218 285/148.28 |
| 3,025,855 | A | * | 3/1962 | Hamilton | 604/251 |
| 3,940,168 | A | * | 2/1976 | Balon | 285/122.1 |
| 4,887,853 | A | * | 12/1989 | Flowers | 285/288.1 |
| 5,375,887 | A | | 12/1994 | Johnson | |
| 5,681,058 | A | * | 10/1997 | Hwang | 285/133.4 |
| 6,442,776 | B1 | | 9/2002 | Oberdörfer | |
| 7,607,453 | B2 | * | 10/2009 | Poskin | E03B 7/10 137/360 |

FOREIGN PATENT DOCUMENTS

| | | | | | |
|---|---|---|---|---|---|
| EP | 1 496 164 | A1 | | 1/2005 | |
| FR | 464202 | | * | 3/1914 | |
| GB | 2186934 | A | * | 8/1987 | F16L 19/08 |

* cited by examiner

CONNECTION ARRANGEMENT BETWEEN A FITTING UNIT AND A MEDIUM PIPE

FIELD OF THE INVENTION

The present invention concerns a connection arrangement between a fitting unit in the form of a tap or an outlet and a medium pipe, including a housing with at least one boring for mounting the medium pipe(s), at which an outer end part of each boring has a first diameter and is provided with a thread for interaction with a threaded fitting for establishing a medium tight connection of the medium pipe.

In the area of liquid and gas installations, a tap in which an outlet is established through a housing is known, and also there are known taps that open for a medium flow passing through a separate outlet. It may thus be said that tap or outlet constitutes a fitting unit. The fitting unit may be intended for front mounting in a support plate with a mounting hole for the housing of the fitting unit.

BACKGROUND OF THE INVENTION

By mounting fitting units, it has been common to place the housing in the mounting hole and to fasten the housing to the support plate.

By front mounting, as applied in the present application, is meant mounting of the fitting unit in a front plate or user plate where there is no need of access to the front plate when the fitting unit is fastened.

However, a connecting arrangement according to the invention may also be used in connection with fitting units that are mounted in the traditional way by mounting the fitting unit from the front side, and then fastening it by screwing a clamping nut on a threaded housing for bearing against the rear side of the support plate.

In prior art connecting arrangements, it is common that the housing of the fitting unit is pre-fitted with a short piece of medium pipe. This short piece of medium pipe will then be connected with supply/discharge line for the medium by separate assembly units. This makes a drawback, as there will be a plurality of assemblies in which there is a risk of leakage. Moreover, the storage of the fitting units will be made difficult, as the pre-fitted pipe piece has such a length that storage is made difficult.

Furthermore, it is a drawback of the prior art connecting arrangements that a fitting unit will be adapted to interact with a certain type or a certain diameter of the associated medium pipes. Alternatively, separate fittings with adaptor pieces are to be used for mutual connection of medium lines with different diameters and/or of different materials.

It is desirable to enable an easier storage and at the same time to increase the applicability of a fitting unit with the intention of coupling to various types and sizes of medium lines, while simultaneously desiring to reduce the number of joints in order to minimise potential points of leakage.

OBJECT OF THE INVENTION

It is the purpose of the present invention to indicate a connecting arrangement of the type mentioned in the introduction whereby the drawbacks of the prior art connecting arrangements may be avoided, while at the same time meeting the wish of increased flexibility when using the connecting arrangement, simultaneously with effecting reduced risk of leakage.

DESCRIPTION OF THE INVENTION

According to the present invention, this is achieved by a connecting arrangement of the type specified in the introduction, which is peculiar in that the fitting is optionally chosen as a nut for squeezing a cutting sleeve around the medium pipe, or as a soldering bushing for mounting the medium pipe by soldering, and that at least one further part with a second diameter, which is less than the first diameter, is provided at each boring and which is adapted for mounting a medium pipe by soldering.

With a connecting arrangement of this type, the housing of the fitting unit may be connected to various types of medium pipes. With a standard housing, it will thus be possible to choose the type of fitting, either nut or soldering bushing, which is suitable for the medium to which the fitting unit is to be applied. Furthermore, it becomes easier to store the connecting arrangement and the fitting units. The fitting unit will consist of the housing itself, and together with such a fitting unit, the required fittings, which enable the user to apply the fitting unit for an actual medium line, may be stored and/or delivered.

Since there are no pipe pieces with substantial length protruding beyond the fitting housing, the product will have less volume and put less demands on the size of physical storage. Thus there is not only possibility of reducing the storage to a store of standard fitting units, but it is also possible that each of these fitting units are less voluminous.

Furthermore, the medium pipes to be used together with the connecting arrangement may be provided with pre-fitted fittings. By pre-fitted fittings, the uncertainty associated with using manual tools on the site when joining medium pipes, is avoided. Since the medium pipes are furthermore joined directly in the fitting unit, one avoids joining of pipe ends projecting from medium housing and supply/discharge pipes. By such connections between pipes, there will always be double joints so that each joint between two pipe ends in practice implies two risks of leaking, whereas by mounting according to the present invention, there will only be a risk of leakage at the medium pipe connection in the fitting housing. The risk of leakage is further reduced in that the pipe ends, as mentioned, may be provided with pre-mounted fittings for connecting with the fitting unit.

The fitting unit can be used together with fittings that are screwed into the thread, but will have increased flexibility as medium pipes may alternatively be fastened directly into the further part of the boring by soldering.

According to a preferred embodiment of the invention, the connecting arrangement is peculiar in that an inner third and innermost part with a third diameter is provided at each boring, the third diameter being less than the second diameter, and that the third diameter is adapted for mounting of a medium pipe by soldering. It is possible hereby that for each boring, medium pipes may be fastened by using a threaded fitting, or alternatively by soldering medium pipes with a first diameter in the further part of the boring which has a second diameter, and a further medium pipe will in this embodiment also be mounted in the third and innermost part of the boring by soldering in this part. The stepped shape of the boring with different diameters will thus enable connection of medium pipes with different diameters. Furthermore, the possibility of mounting via a threaded fitting will enable mounting of medium lines, as e.g. plastic tubes, reinforced rubber hoses or soft plastic (preferably, cross-linked polyethylene, which is known as PEX) pipes which are mounted by means of cutting sleeves that are squeezed between medium line and nuts for providing a medium tight connection.

According to a further embodiment of the connecting arrangement according to the invention, which has a threaded fitting in the form of a soldering bushing, the arrangement will be peculiar in that a boring is provided in the soldering bushing, the boring having a first part with a fourth diameter and which is adapted to mounting a medium pipe by soldering, and a further part with a fifth diameter which is less than the fourth diameter, and which is adapted to mounting a medium pipe by soldering.

Hereby, the connecting arrangement will provide a possibility of soldering medium pipes with up to two different diameters to the soldering bushing. This soldering bushing may be pre-fitted on the pipe end, or alternatively the soldering may also occur on site, where the user has the possibility of soldering pipes with diameters that are adapted to the fourth and fifth diameter in the boring of the soldering bushing. Such a design with soldering bushing will preferably be used in connection with medium pipes of metal, preferably stainless steel, where a cutting sleeve will have difficulty in establishing the required medium sealing by "biting" into the hard medium pipe.

The connecting arrangement according to the invention may be used with medium pipes in the form of air and liquid pipes, which are preferably gas and water lines. Such lines may be made of metal in the form of stainless steel or copper pipes. When plastic is used, it will preferably be PEX-pipes which are used as medium lines.

When metal pipes are used, it may be straight pipes or pipes where the outer end is collared for providing an increase in diameter so that small pipe dimensions are provided end parts with standard pipe dimensions which are adapted to standard dimensions for fitting units.

In a connection arrangement where the threaded fitting is a nut for squeezing a cutting sleeve around the medium pipe, it will furthermore be possible that the used cutting sleeve is a reduction cutting sleeve. The connection arrangement according to the invention will hereby obtain a wider application range for medium pipes with different diameters.

According to a further embodiment, the connection arrangement is peculiar in that a support bushing is provided inside the end part of the medium pipe. This will usually be applied in connection with plastic pipes, and in some case soft copper pipes as well. This contributes to secure a medium tight connecting of the pipe in a connecting arrangement according to the invention.

The connecting arrangement according to the invention may be used as a part of or integrated with the housing in a fitting unit including a front mounted tap or a front mounted outlet, preferably for gas and liquid. By a front mounted outlet, there will, as mentioned above, be mounting from the front side. Here, it will be a particular advantage to use a connecting arrangement according to the invention, as mounting as well as servicing may be effected in that medium pipes are drawn out through the mounting hole and fastened to the fitting unit. Then the fitting unit may be brought into position without any need of interfering or working behind the mounting plate.

In a further embodiment, the connecting arrangement is provided with a standard fitting housing which can be used in connection with commonly occurring standard dimensions. In such a situation it is preferred that the various diameters are dimensioned for medium pipes with different standard diameters, preferably for diameters of 8 mm, 10 mm, 12 and ⅜".

However, it is to be remarked that the connecting arrangement can be arranged with diameters that enable other dimensions for medium pipes. In all situations, there is achieved the advantages of using a standard fitting unit which may be used together with medium pipes with different diameters and/or of different types of material.

DESCRIPTION OF THE DRAWING

The invention will in the following be explained more closely with reference to the accompanying drawing, wherein.

DETAILED DESCRIPTION OF THE INVENTION

Identical and corresponding elements will be designated with the same reference numbers in the following, and no specific explanation will be given to all details in connection with each single Figure.

Figure 1:
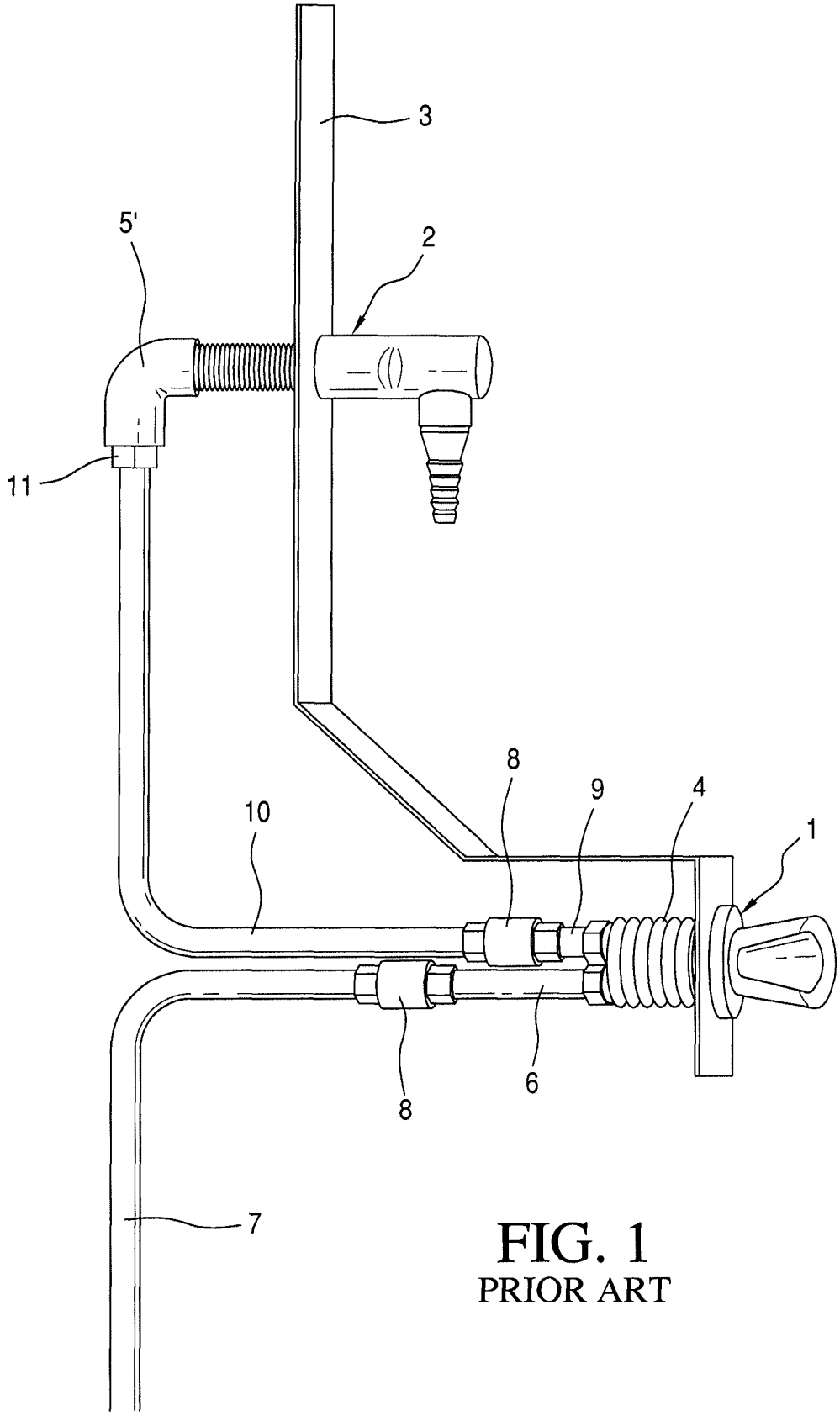
FIG. 1 PRIOR ART
FIG. 1 shows a schematic elementary sketch of fittings according to a prior art principle.

FIG. 1 shows a prior art arrangement for mounting fitting units. There is shown a fitting unit in the form of a tap 1 and a fitting unit in the form of an outlet 2. The tap 1 and the outlet 2 are mounted in a wall 3. The tap 1 includes a fitting housing 4 and the outlet 2 includes a threaded section 5'. The fitting housing 4 is provided with a pipe section 6 for connecting to a supply line 7 via a double joint 8 of the two pipes. The housing 4 is furthermore provided with a pipe section 9 for connecting with a supply line 10 via a corresponding double joint 8. The double joints 8 are prior art fittings where the pipe ends are connected at each end by a fitting in a known way, e.g. by means of nuts. The supply line 10 is connected with the threaded section 5' in the shown embodiment via a double joint 11 to the threaded section. In each of the joints there will be a risk of leakage.

Figure 2:
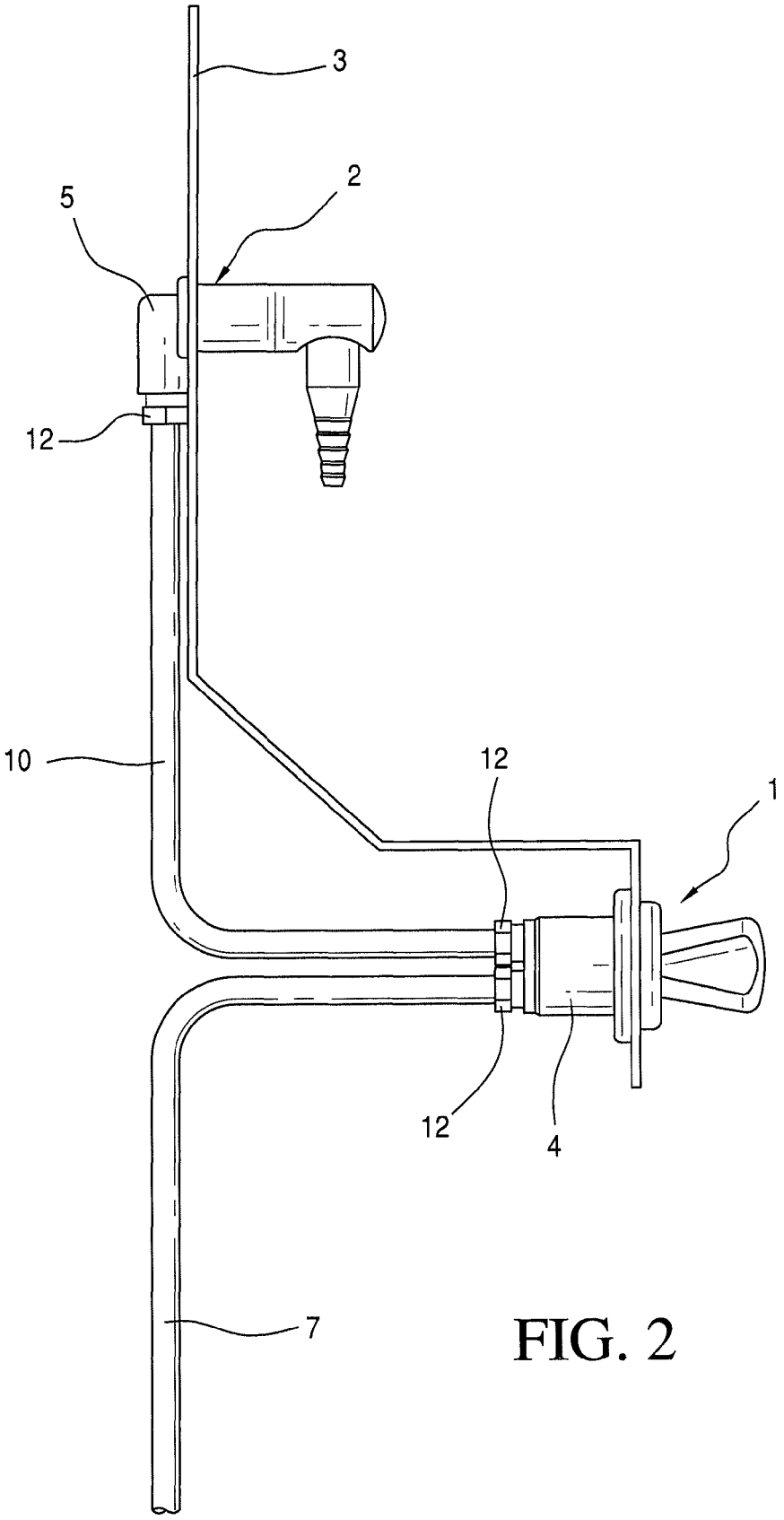
FIG. 2 shows an elementary sketch corresponding to FIG. 1 by applying a connecting arrangement according to the present invention.

In FIG. 2 appear corresponding elements. In this embodiment, the pipes 7 and 10 are connected with the fitting housings 4 and 5 via integrated joints 12 which are designed according to the present invention. As it is seen, by this arrangement there will be a reduced number of leakage risks which are limited to the points of the integrated joint. Furthermore, it appears that the fitting unit 1 according to FIG. 2 has a limited size, as it does not include the permanently connected pipes 6, 9 (cf. FIG. 1). Furthermore, it is also noted that the system illustrated in FIG. 1, besides risks of leakage at the double joints, will also have a risk of leakage in the connection established between the pipe sections and the fitting housing.

Figure 3:
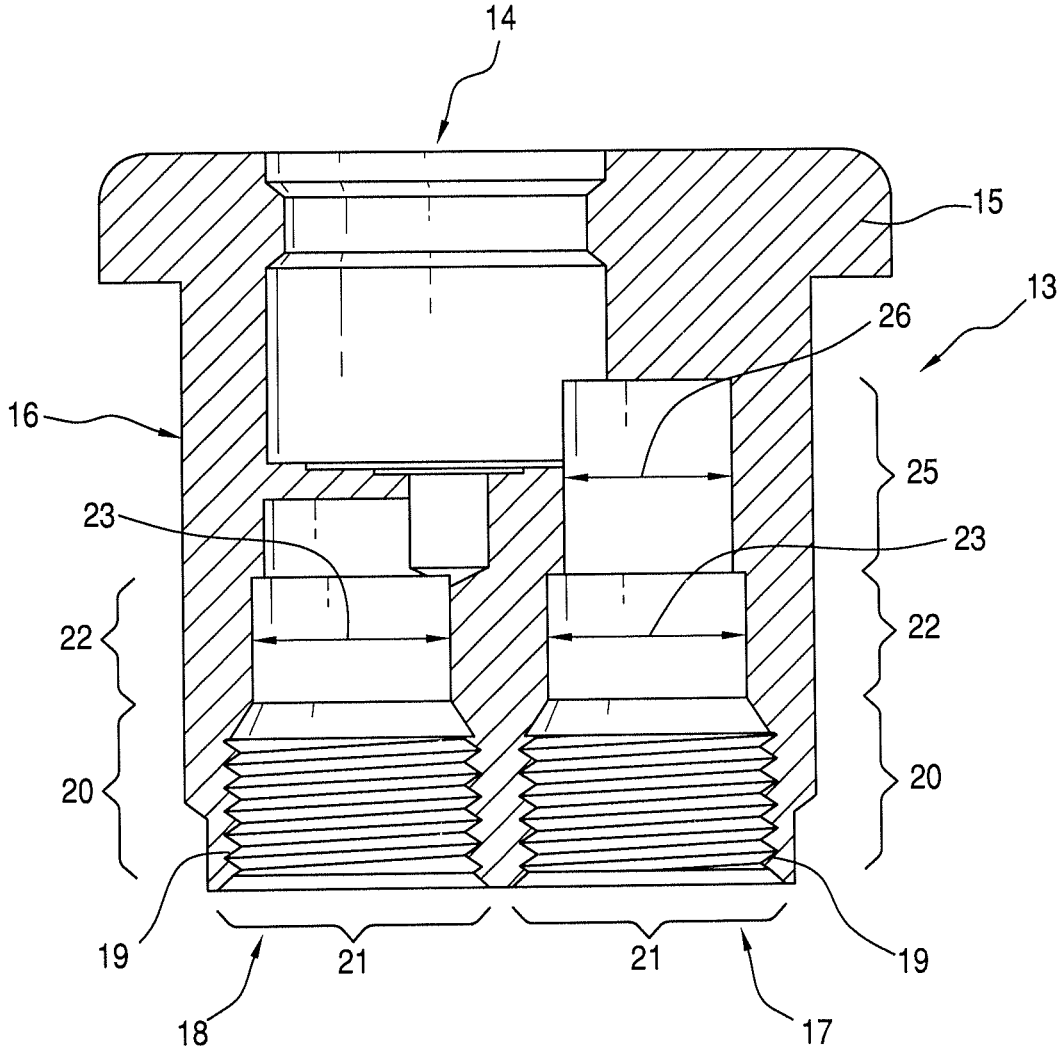
FIG. 3 shows a sectional view through a fitting housing for use in a connecting arrangement according to the present invention.

FIG. 3 shows a section through a fitting housing 13. This fitting housing has a boring 14 for receiving a valve body 58 (see FIGS. 4-6). The fitting housing 13 has an abutment flange 15 and a cylindric part 16 that may optionally be provided with thread for receiving a nut or be provided with other means for use in clamping the fitting housing 13 in a mounting aperture in a mounting plate.

The fitting housing 13 comprises a first boring 17 and a second boring 18. At their outer end, each of these borings is provided with a thread which is provided with a part 20 of the boring with a first diameter 21. Each of the borings include a further part 22 with a second diameter 23 which is less than the first diameter 21. The second part 22 of the boring is smooth and intended for mounting a medium pipe 24 (see FIG. 4) by soldering (in FIG. 4 soldering is not shown).

The boring 17 is furthermore provided with an inner third part 25 with a third diameter 26 which is less than the second diameter 23. The third part 25 is smooth and intended for connecting gas and liquid to a valve in the boring 14.

Figure 4:
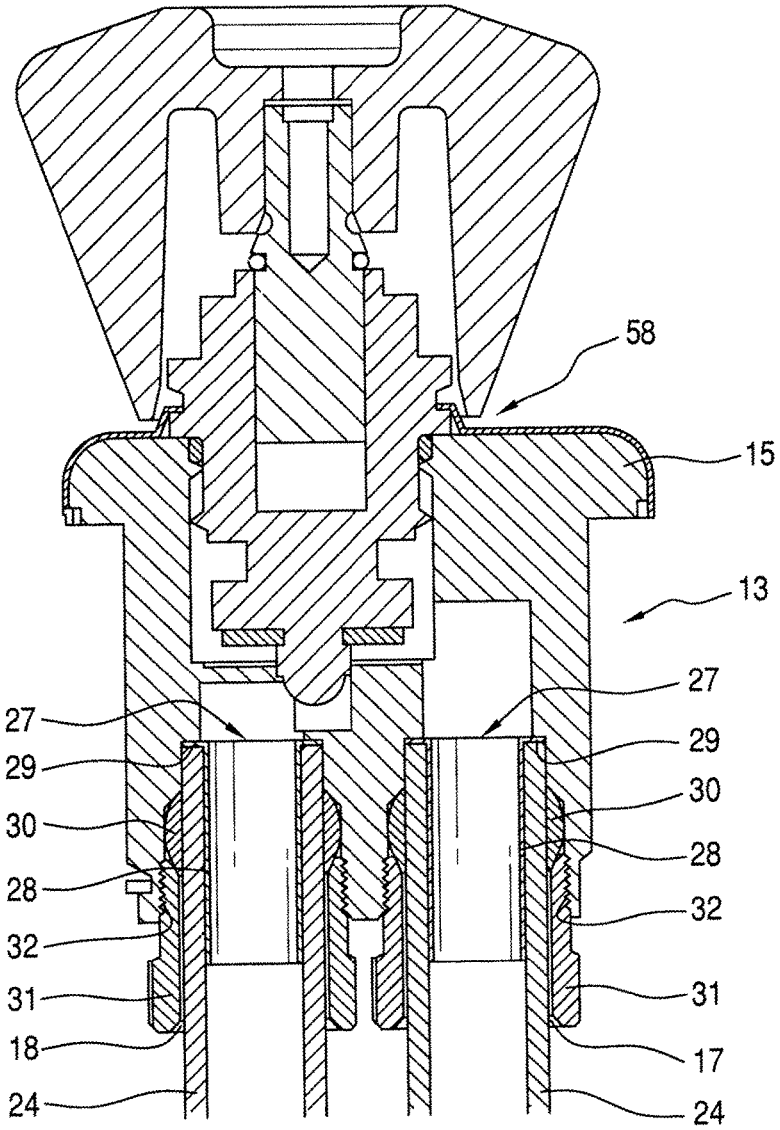
FIG. 4 shows a sectional view through a connecting arrangement where the fitting housing shown in FIG. 3 is used.

FIG. 4 illustrates how medium pipes 24 are mounted in the borings 17 and 18. In the innermost end of the medium pipes, there is provided a support bushing 27 consisting of a tubular cylindric part 28 and an outwards directed cylindric collar 29 resting on the end face of the medium pipe 24.

The medium pipe 24 is mounted in the boring 17 and 18 by means of a cutting sleeve 30 and a nut 31 having a thread 32 which interacts with the thread 19 in the borings 17 and 18. The medium pipe 24 will preferably be copper pipes, flexible hoses, reinforced rubber hoses or PEX pipes.

Figure 5:
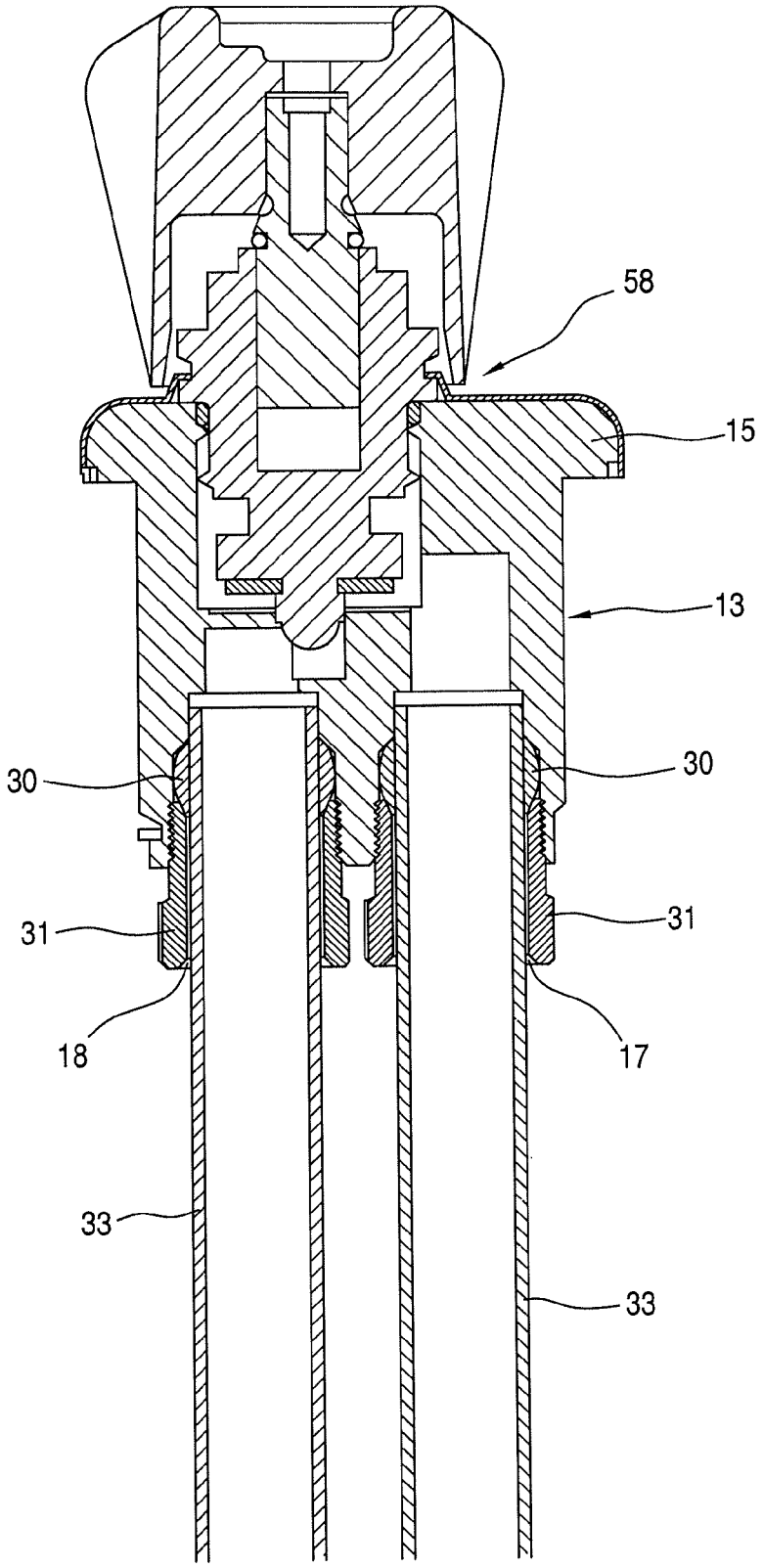
FIG. 5 shows a sectional view through a connecting arrangement where the fitting housing shown in FIG. 3 is used.

FIG. 5 illustrates a further embodiment where medium pipes 33 are mounted in the borings 17 and 18. The medium pipes 33 are copper pipes. Also here the pipes 33 are mounted by means of a cutting sleeve and an interacting nut 31. In this embodiment, no support bushings have been provided. Alternatively, it is, however, possible to use support bushings in connection with the copper pipe, but this depends on the strength of the pipes 33.

Figure 6:
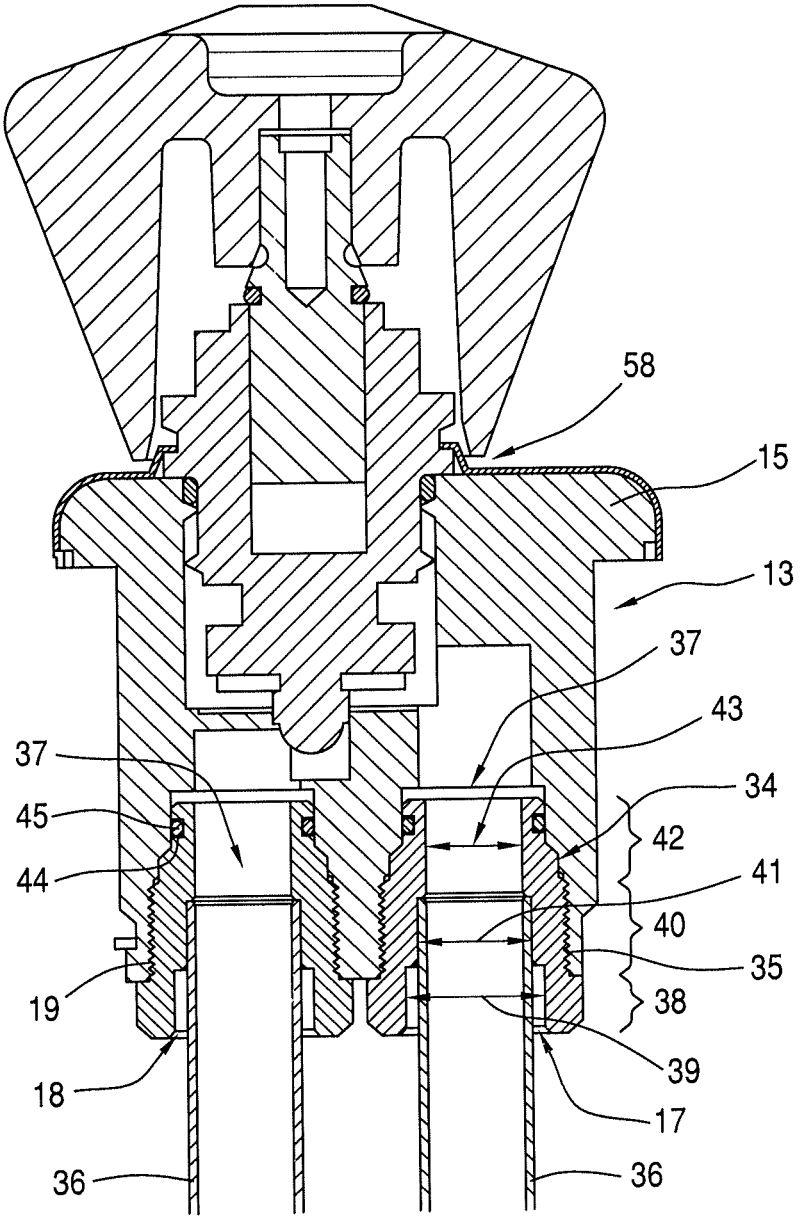
FIG. 6 shows a further connecting arrangement where the fitting housing shown in FIG. 3 is used.

FIG. 6 shows a further embodiment where in the borings in the fitting housing 13 there is screwed a soldering bushing 34 which is provided with a thread 35 interacting with the thread 19 in the borings. In each soldering bushing 34 there is connected a medium pipe 36 of metal and which is mounted by soldering.

Each soldering bushing is provided with a boring 37 having a first part 38 with a fourth diameter 39. A further part 40 of the boring 37 is provided with a fifth diameter 41 which is less than the fourth diameter 39. Furthermore, the soldering bushing has an innermost part 42 with a sixth diameter 43 which is less than the fifth diameter 41.

In the soldering bushing, each of the parts 38, 40 and 42 are smooth, and the diameters have a size adapted to mount medium pipes 36 by soldering. The shown soldering bushing 34 may thus be used for medium pipes with three different diameters. In order to ensure sealing between the soldering bushings 34 and the bends in the fitting housing 13, the soldering bushings are provided with an annular groove 44 accommodating a sealing element, preferably an O-ring 45.

Figure 7:
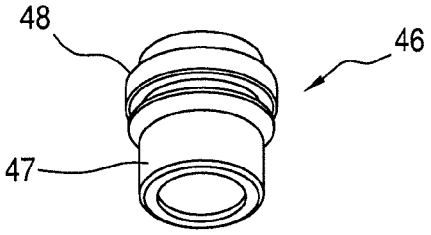
FIG. 7 shows a perspective view of a reduction cutting sleeve for use in a connection arrangement according to the invention.

FIG. 7 illustrates an example of a reduction cutting sleeve 46 for use in reducing the diameter of a medium pipe. The reduction cutting sleeve includes a first tubular bushing 47, which is used for squeezing a medium pipe, and a second bushing member 48, which is displaceable in relation thereto. The first and second bushing members 47 and 48 have conical parts for engaging each other in order to provide the sealing when a nut presses the bushing member 48 against the bushing member 47.

Figure 8:
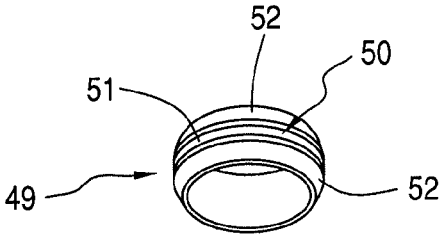
FIG. 8 shows a perspective view of a cutting sleeve for use in a connection arrangement according to the invention.

FIG. 8 illustrates a traditional cutting sleeve 49 having an outer surface 50 with a largely plane center part 51, and two edge parts 52 sloping in relation thereto.

Figure 9:
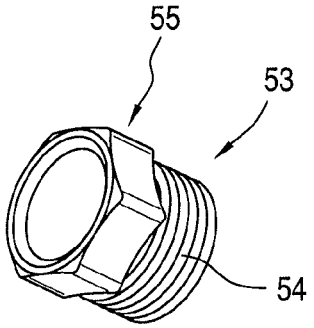
FIG. 9 shows a perspective view of a squeeze fitting for use in a connection arrangement according to the invention.

FIG. 9 shows a nut 53 for use together with the cutting sleeve 49 shown in FIG. 8. The nut 53 includes a threaded part 54 for interacting with the thread 19 in the boring in the fitting housing 13 and a second end part 55 with bearing faces for interacting with a tool in the shape of a spanner, an adjustable wrench or similar for screwing on the nut, thereby establishing a medium tight connection.

Figure 10A:
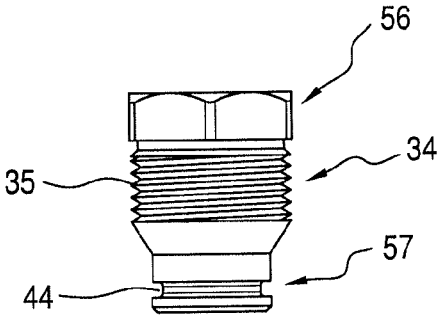
FIGS. 10A, 10B & 10C show, respectively, views from the side, from above and in perspective of a soldering bushing for use in a connection arrangement according to the invention.
Figure 10B:
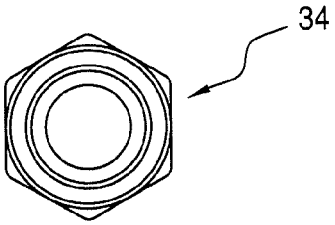
Figure 10C:
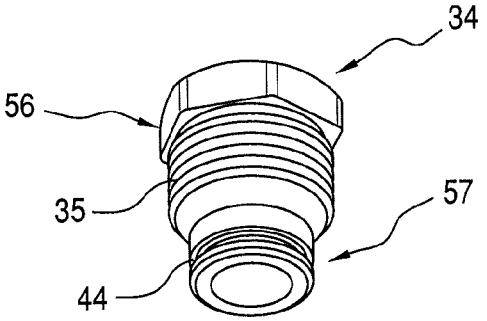

FIG. 10 shows as view A a side view of a soldering bushing 34, as view B a view of the soldering bushing 34 seen from above, and as view C a perspective view of the soldering bushing 34.

The soldering bushing includes a threaded part 35 for interacting with the thread 19 in the fitting housing 13. An outer end 56 of the soldering bushing is provided with contact surfaces for a clamping tool in the form of a spanner or similar, and with an innermost end 57 having a smaller diameter in order to protrude into the further part of the boring of the fitting housing having less diameter than the first diameter at the thread 19. The soldering bushing is furthermore provided with a groove 44 for receiving a sealing element.

In view B appear generatrices for the various diameters of the soldering bushing 34, as explained with reference to FIG. 6.

The invention claimed is:

1. A connection arrangement, comprising:

a valve for regulating flow of liquid or gas, the valve having a valve body; and a fitting housing;

wherein the fitting housing comprises:

a valve bore inside of which the valve body is positioned;

a first bore and a second bore for sealing insertion of medium pipes, each of the first and second bores having a first diameter provided with a thread in the respective bore, a cylindrical second part with a second diameter which is less than the first diameter; and a third part with a third diameter which is less than the second diameter;

wherein a conical tapering transition is provided in the first and second bores remotely from the thread at a location between the thread and the cylindrical second part for providing a first sealing contact surface; a cutting sleeve and wherein the second part of the bore has a smooth sealing abutment surface, wherein the first bore and the second bore are parallel and provided side-by-side;

wherein the valve bore is cylindrical with a central axis that is parallel to the first and second bores, wherein the valve extends from the valve bore in a direction that is away from the first and second bores and along the central axis, and wherein the movement of the valve for opening and closing the fluid-flow communication is along the central axis wherein the third part of each of the first and second bore has an opening directed towards the valve bore for fluid-flow communication of gas or liquid between the first and second bores through the valve bore and the valve; the third part of the first bore being shorter than the third part of the second bore; wherein the valve body is configured with an end portion for directly closing off a passage between the valve bore and the third part of the first bore, but not closing the opening of the third part of the second bore that is directed towards the valve bore, wherein the first bore is a fluid inlet bore and the second bore is a fluid outlet bore.

2. A connection arrangement according to claim 1, wherein a right angular transition from the second diameter to the third diameter is provided between the cylindrical second part and the third part.

3. A connection arrangement according to claim 1, wherein the fitting housing further comprises an abutment flange and a cylindrical part extending from the abutment flange, and wherein the first bore and the second bore are provided within the cylindrical part, and wherein the abutment flange is cylindrical with a diameter that is larger than a diameter of the cylindrical part.

4. A connection arrangement, comprising:

a valve for regulating flow of liquid or gas, the valve having a valve body; and a fitting housing;

wherein the fitting housing comprises:

a valve bore inside of which the valve body is positioned;

a first bore and a second bore for sealing insertion of medium pipes, each of the first and second bores having a first diameter provided with a thread in the respective bore, a cylindrical second part with a second diameter which is less than the first diameter; and a third part with a third diameter which is less than the second diameter;

wherein the second part of the bore has a smooth surface for sealing abutment with an O-ring;

wherein a conical tapering transition is provided in the first and second bores remotely from the thread at a location between the thread and the cylindrical second part for providing a sealing contact surface; and wherein the third part of each of the first and second bores is connected to the valve bore through an opening providing fluid-flow communication of gas or liquid between the first and second bores through the valve bore;

wherein the valve bore is cylindrical with a central axis, wherein the valve body is configured for displacement along the central axis, the displacement along the central axis to an end position directly closing off communication between the valve bore and the third part of the first bore, but not closing the opening of the third part of the second bore that is directed towards the valve bore; and wherein the opening of the third part of the first bore is located in a wall of the valve bore at a position located laterally offset from said central axis, and wherein the first bore and the second bore are parallel and provided side-by-side; wherein the valve bore is cylindrical with a central axis that is parallel to the first and second bores, wherein the valve extends from the valve bore in a direction that is away from the first and second bores and along the central axis, and wherein the movement of the valve for opening and closing the fluid-flow communication is along the central axis.

5. A connection arrangement according to claim 4, wherein the third part of the first bore is shorter than the third part of the second bore, wherein the valve bore has a first part configured for receiving the valve body and a second part of a smaller diameter than said first part of the valve bore and in a circumferential wall of which said opening is located.

* * * * *